US008113343B2

(12) United States Patent
Åkerlind

(10) Patent No.: US 8,113,343 B2
(45) Date of Patent: Feb. 14, 2012

(54) PORTABLE CIGARETTE ASHES CONTAINER WITH CIGARETTE LIGHTER

(75) Inventor: Jan Åkerlind, Stockholm (SE)

(73) Assignee: Cigbuster AB, Stockholm (SE)

( * ) Notice: Subject to any disclaimer, the term of this patent is extended or adjusted under 35 U.S.C. 154(b) by 34 days.

(21) Appl. No.: 12/523,236

(22) PCT Filed: Jan. 16, 2008

(86) PCT No.: PCT/SE2008/000034

§ 371 (c)(1),
(2), (4) Date: Jul. 15, 2009

(87) PCT Pub. No.: WO2008/088274

PCT Pub. Date: Jul. 24, 2008

(65) Prior Publication Data

US 2009/0314662 A1 Dec. 24, 2009

(30) Foreign Application Priority Data

Jan. 16, 2007 (SE) ..... 0700078
Oct. 16, 2007 (SE) ..... 0702322

(51) Int. Cl.
*B65D 85/10* (2006.01)
*A24D 1/12* (2006.01)

(52) U.S. Cl. ..... 206/86; 206/85; 206/246; 131/231; 131/238

(58) Field of Classification Search ..... 206/85, 206/86, 246, 259, 38; 131/235.1, 241, 238, 131/240.1, 256, 231; 431/253, 126
See application file for complete search history.

(56) References Cited

U.S. PATENT DOCUMENTS

| | | | | |
|---|---|---|---|---|
| 2,233,324 | A | 2/1941 | Palmer | |
| 4,240,783 | A | 12/1980 | Nevin et al. | |
| 4,473,084 | A * | 9/1984 | Marshall | 131/235.1 |
| 5,465,738 | A * | 11/1995 | Rowland | 131/329 |
| 5,605,226 | A | 2/1997 | Hernlein | |
| 5,630,503 | A * | 5/1997 | Rhodes et al. | 206/85 |
| 5,673,709 | A | 10/1997 | Brothers | |
| 5,706,975 | A * | 1/1998 | Cronk | 220/737 |
| 5,810,164 | A * | 9/1998 | Rennecamp | 206/256 |

(Continued)

OTHER PUBLICATIONS

English Language International Search Report dated May 5, 2008 issued in parent Appln. No. PCT/SE2008/000034.

*Primary Examiner* — J. Gregory Pickett
*Assistant Examiner* — Ernesto Grano
(74) *Attorney, Agent, or Firm* — Holtz, Holtz, Goodman & Chick, PC

(57) ABSTRACT

A portable cigarette ashes container includes a receptacle and a top portion detachable from the receptacle, and has a top side in which a circular aperture to the interior of the receptacle and a further aperture to an upwards open pocket situated in the receptacle are situated, in which pocket a gas container of a cigarette lighter is received. A tubular passage having a length longer than the length of a cigarette butt and the same diameter as the cigarette butt is tightly secured to the edge of the circular aperture. A cap is hingedly connected to the top side of the top portion. The cap is provided with an interior closure member, which with the cap in closed position tightly closes the opening of the passage in the top side of the top portion.

10 Claims, 6 Drawing Sheets

U.S. PATENT DOCUMENTS 5,967,310 A * 10/1999 Hill ..... 206/242
5,967,312 A * 10/1999 Jacobs ..... 206/266
6,446,793 B1 * 9/2002 Layshock ..... 206/86
6,474,342 B1 * 11/2002 Rennecamp ..... 131/241
6,693,850 B2 * 2/2004 Mulaw ..... 368/10
D527,139 S * 8/2006 Deahl ..... D27/129
7,717,259 B2 * 5/2010 Hatton ..... 206/236
2005/0236005 A1 * 10/2005 Bears et al. ..... 131/235.1

* cited by examiner

PORTABLE CIGARETTE ASHES CONTAINER WITH CIGARETTE LIGHTER

BACKGROUND OF THE INVENTION

1. Field of the Invention

The present invention relates to a portable cigarette ashes container, comprising a receptacle and a top portion, detachable from the receptacle, and having a top side in which a circular aperture to the interior of the receptacle and a further aperture to an upwards open pocket situated in the receptacle are situated, in which pocket a gas container of a cigarette lighter with lighter device belonging to it protruding above the top side is received.

2. Description of Related Art

A container of this type is priorly known from U.S. Pat. No. 5,673,709. This container comprises an open receptacle, which by a partition wall is divided into a chamber for ashes and cigarette butts, and a chamber for the gas container of a cigarette lighter, and a circular lid, which is arranged to be screwed to the open end of the receptacle. The lid is provided partly with an feeding-in aperture for inserting and dropping cigarette butts into an intended space, and partly with an aperture for reaching the lighter device of the cigarette lighter. In order to prevent ashes from falling out through the feeding-in aperture this aperture is provided with a spring-loaded flap on the under side of the lid. A container of this type is impaired by several disadvantages which makes it unsuitable for the intended purpose. Due to the fact that the lid has to be screwed on the receptacle the edge of the partition wall and the lighter device have to be located low enough to permit the flap to pass by without scraping against the partition wall or the lighter device. This results in the fact that if the container is inclined or is held upside-down, ashes will fall out through the aperture above the cigarette lighter. This applies also if the lid is pushed onto the receptacle and is locked by a snap-in closure. It is difficult to adjust the aperture in relation to the cigarette lighter in order to minimize the interspace, which, anyhow, cannot be completely eliminated. This is especially embarrassing because the lid has to be removed and replaced each time the container has to be emptied, which often is carried out in dull light.

SUMMARY OF THE INVENTION

The object of the invention is to achieve a portable container of the type mentioned by way of introduction, which is improved such, that the above mentioned inconveniences are eliminated in a simple and efficient way. It is especially important that the container can have a shape that permits keeping of the container without inconvenience in a pocket or handbag. It is also important that the container is almost hermetic sealed, and that the container can be easily opened and closed.

This is achieved, according to the invention, in that the portable container is characterized by the subject matter mentioned in the following claims.

With such a portable container for ashes with a built-in cigarette lighter for lighting a cigarette available a smoker always knows where to get rid of the glowing butt, namely by pushing the butt with the glow foremost down into the tubular passage. The mouth end or mouthpiece of the cigarette forms a plug that relatively quick chokes the glow, because the top portion is integrated with the pocket for the cigarette lighter and has a cap that in closed position closes the tubular passage, and consequently forms an airtight seal of the space enclosing the ashes and the cigarette butts. When the next butt or a following butt is pushed down into the passage the lowest butt falls down in the receptacle, which when required can be removed for emptying.

BRIEF DESCRIPTION OF THE DRAWINGS

The invention is more clearly described in the following with reference to the attached drawings which schematically show by way of example two embodiments of a portable container according to the invention.

DETAILED DESCRIPTION OF THE PREFERRED EMBODIMENTS

Figure 1:
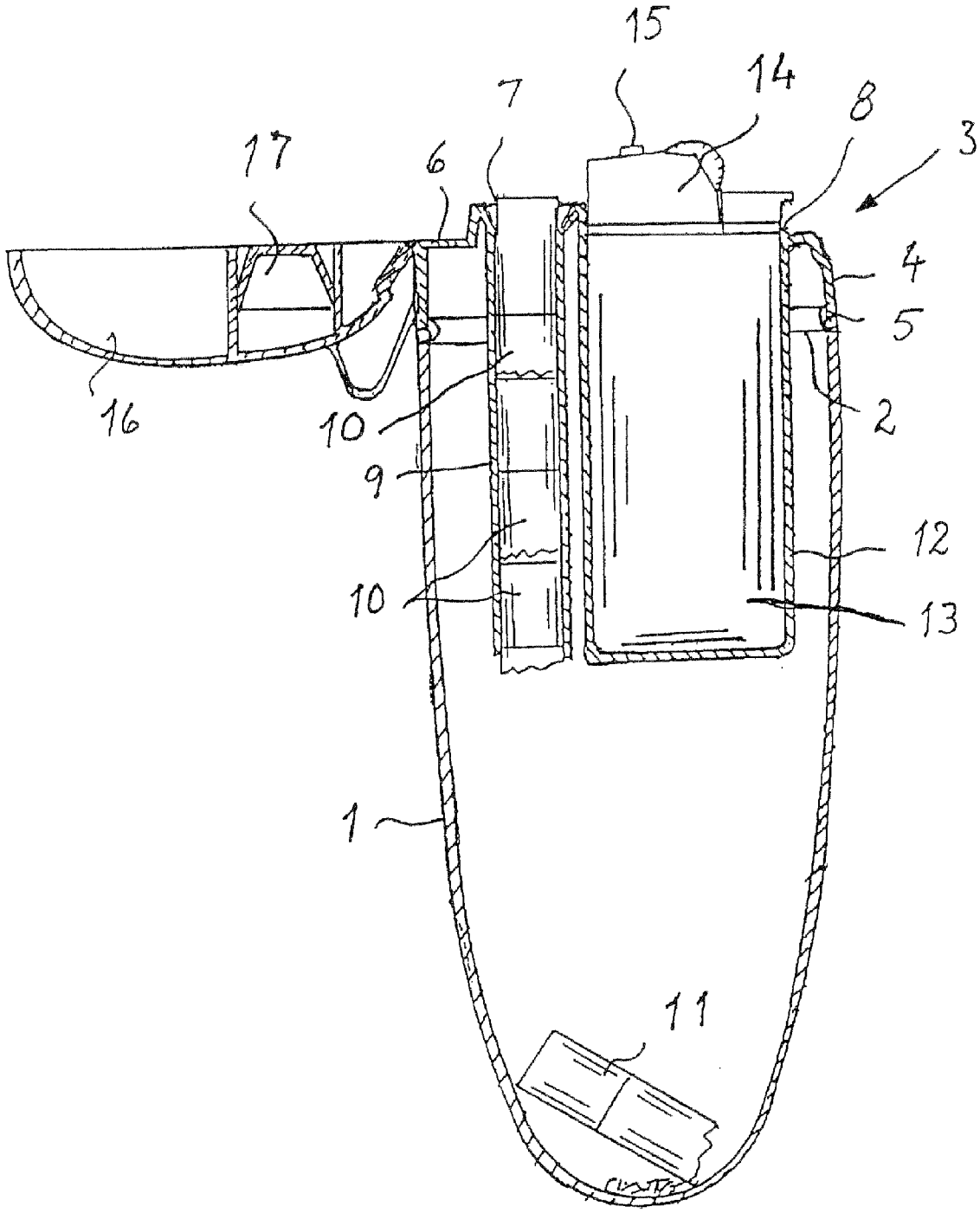
FIG. 1 is a longitudinal sectional view of the top portion with a cap belonging to it and the receptacle.

FIG. 1 discloses a receptacle 1 with an opening 2 which is closed by a top portion 3. The top portion has a side wall 4 with an edge which follows the edge of the receptacle 1 at its opening 2, where the two edges are detachably connected to each other by a conventional snap-in locking device 5. The top portion is further designed with a top side 6 with a circular aperture 7 and an oval aperture 8. A passage 9 with a diameter essentially equal to the diameter of a cigarette extends from the aperture 7. The passage leads to the interior of the receptacle 1 and has a length essentially equal to three cigarette butts 10, which have been inserted into the passage through the aperture 7. A butt 11 inserted just before the lowest butt 10 has dropped down from the passage 9 and rests on the bottom of the receptacle 1.

The top side 6 of the top portion also has a pocket 12 extending from the aperture 8 with the same interior shape as the gas container 13 of a conventional cigarette lighter which is pushed down into the pocket 12 with its lighter device 14 accessible at the upper side of the cigarette lighter, and with a discharge hole 15 for the gas directed up from the upper side of the top portion.

A cap 16 hingedly connected to the top portion 3 has an interior closure member 17, which closes the aperture 7 to the passage 9, when the cap is swung in over the top portion 3.

Figure 2:
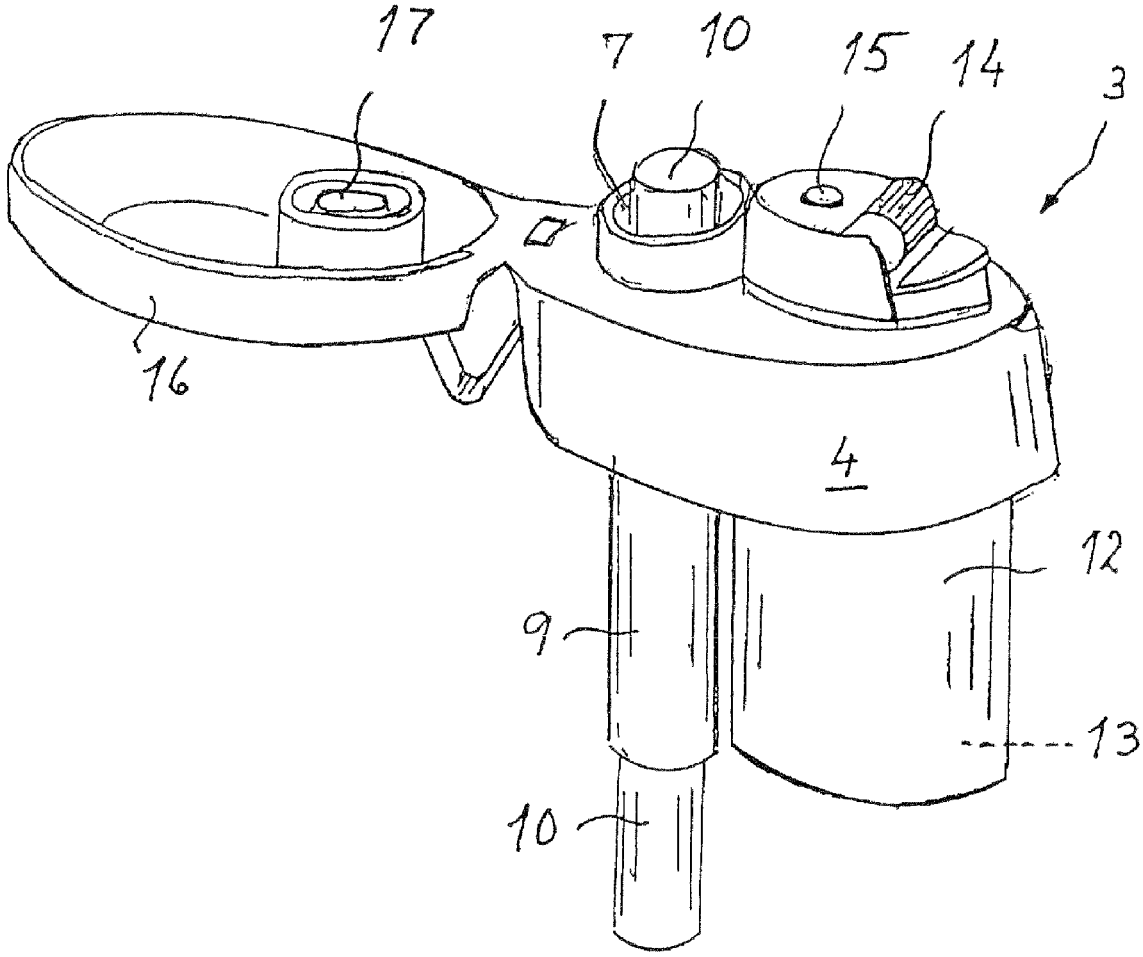
FIG. 2 is a perspective view of the top portion, the cap and the upper part of a protruding conventional cigarette lighter.

FIG. 2 discloses the top portion 3 with the cap 16 and the gas container 13 (not shown) of a conventional cigarette lighter inserted into the pocket 12, and its lighter device 14 protruding from the upper side of the top portion 3.

Figure 3:
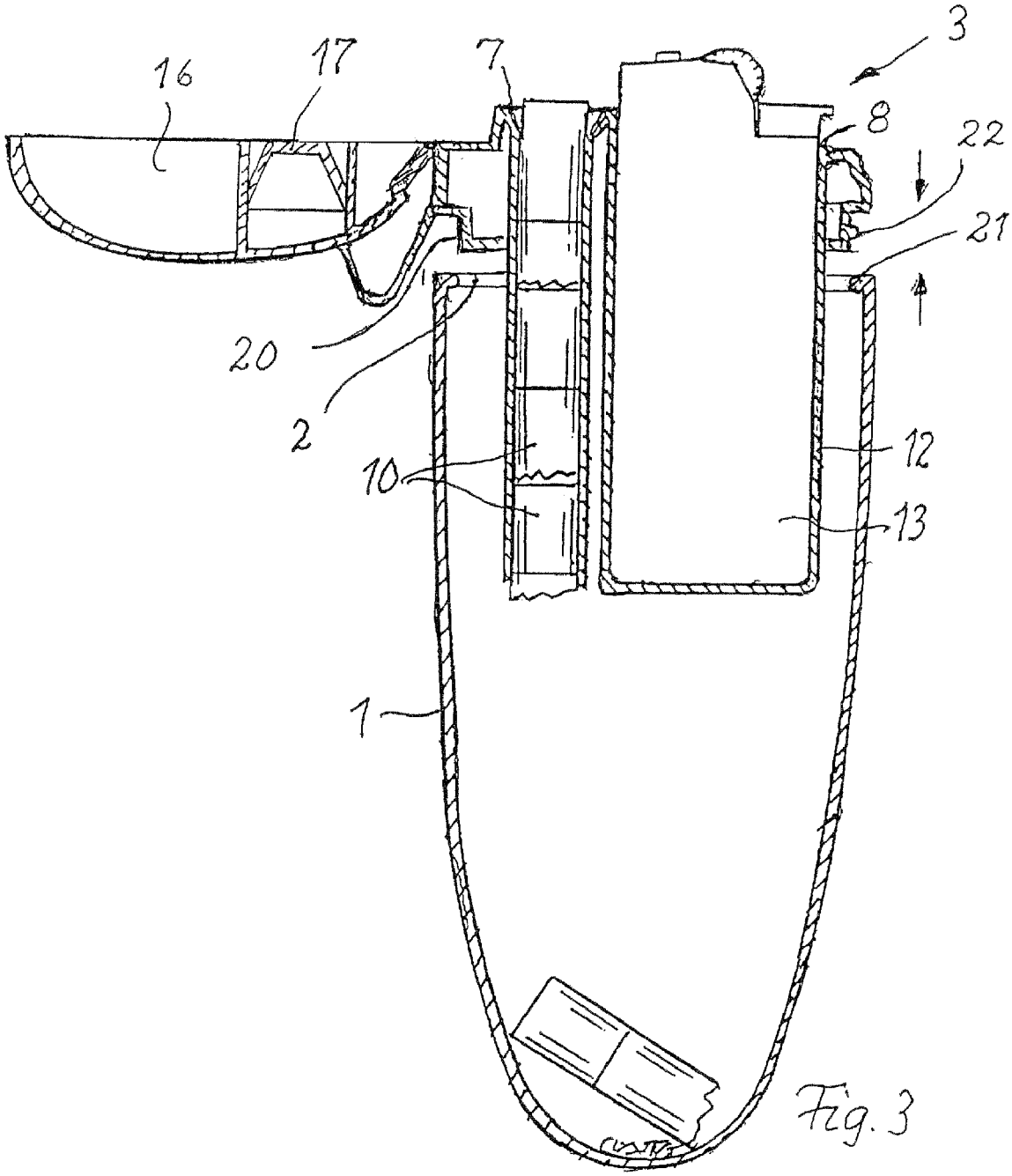
FIGS. 3 and 4 are each the same view as FIG. 1 but showing a preferred embodiment of the invention during a compressing of the top portion and the receptacle, and after the compressing, respectively.
Figure 4:
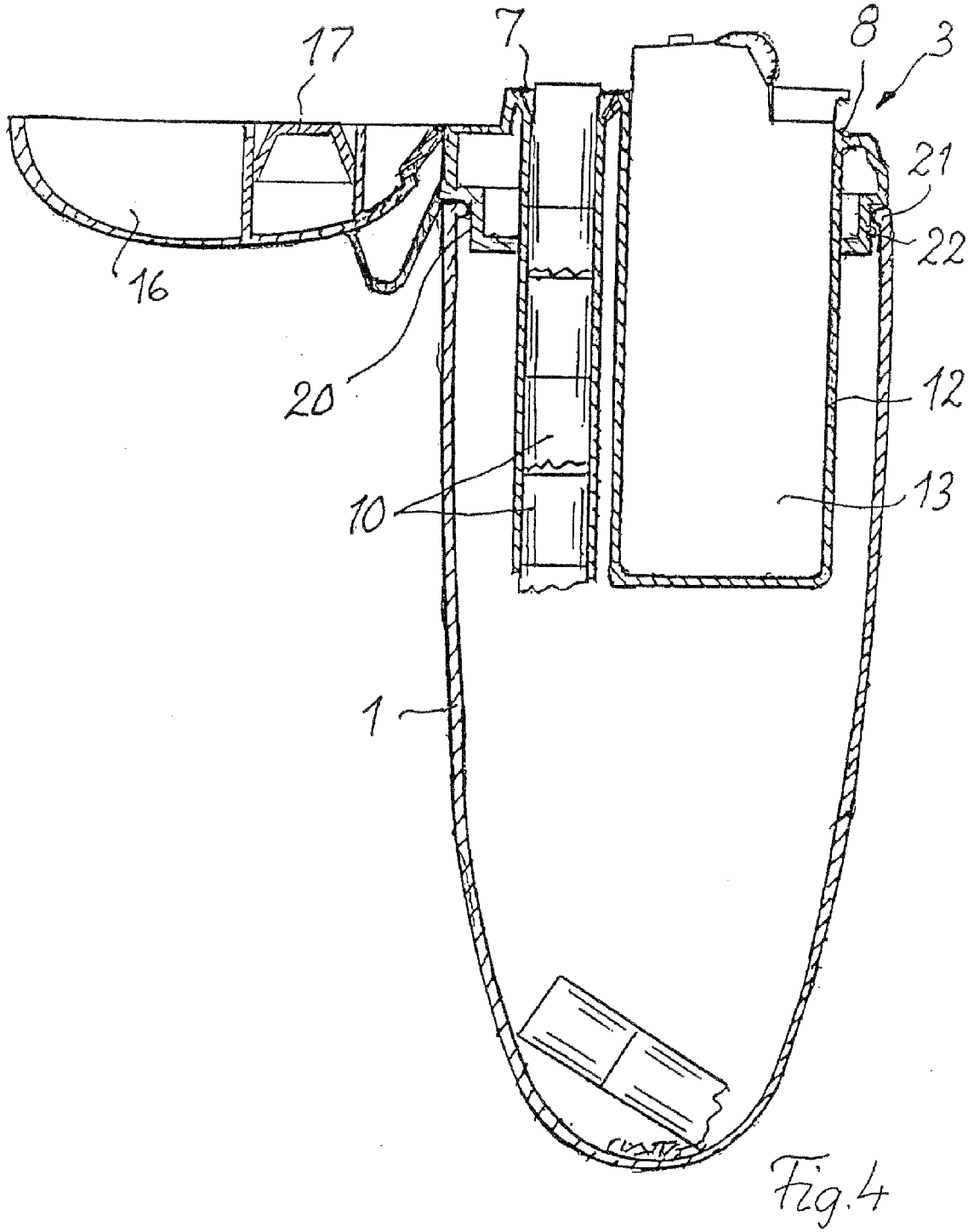
Figure 5:
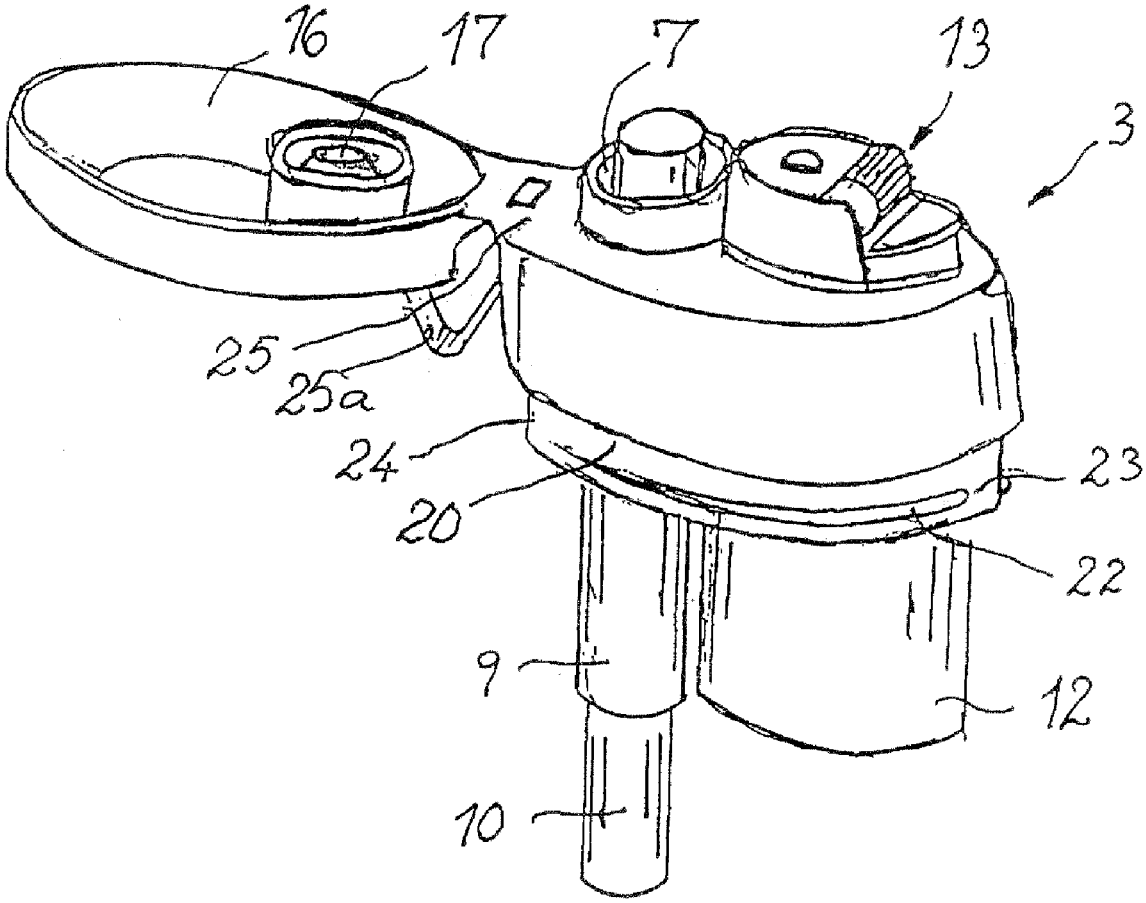
FIG. 5 is a perspective view of the top portion in FIGS. 3 and 4, and FIGS. 6*a,b,c,d* are views of the container according to the invention as seen from four different directions with open cap and closed cap, respectively.
Figure 6A:
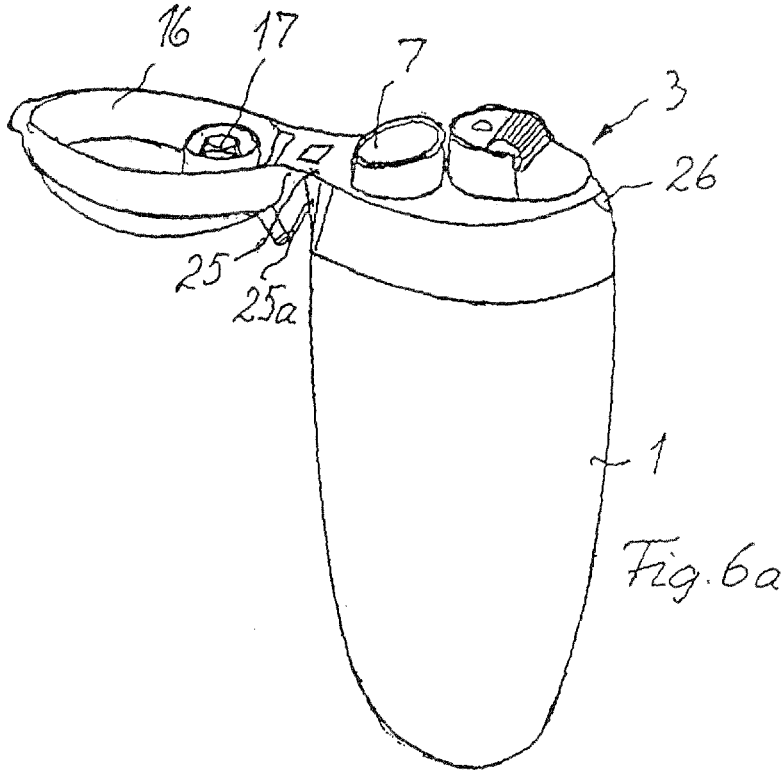
Figure 6B:
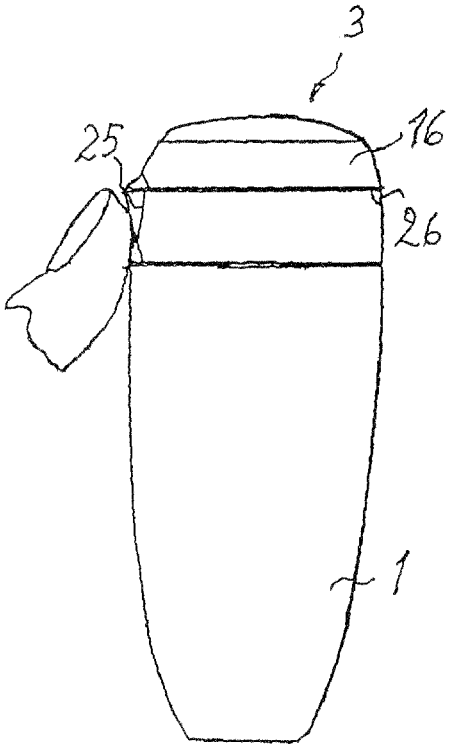
Figure 6C:
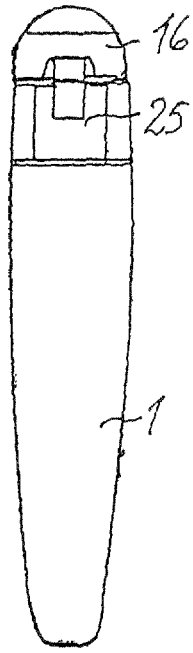
Figure 6D:
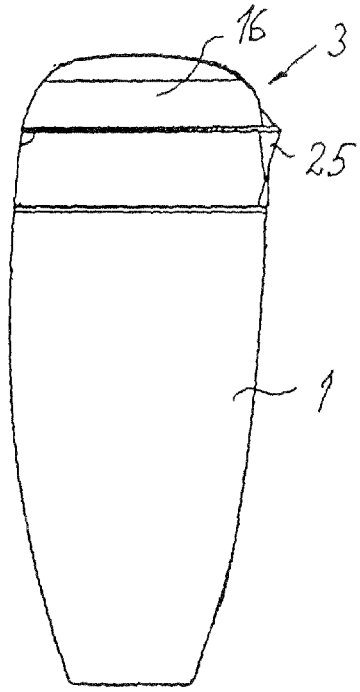

The preferred embodiment, that is shown in FIG. 3 and FIG. 4, differs from the embodiment shown in FIG. 1 and FIG. 2 by the conventional snap-in locking device shown in FIG. 1 and FIG. 2 being replaced by a more efficient snap-in locking device, including that the top portion 3 has been designed with a downwards directed collar 20 with essentially the same exterior shape as the shape of the interior wall of the opening 2 of the receptacle 1, which consists of a ridge 21 which extends around the interior wall of the edge of the opening 2. The collar 20 has an exterior ridge 22, designed such that at pushing together the top portion 3 and the receptacle 1, the ridge 21 displaces outwards under spring action as much as the ridge 21 can slide over the ridge 22 and lock the opening of the receptacle 1 tightly against the top portion 3. This function is possible without the need of an impractically strong force, partly due to the opening having an oval, flattened shape, partly due to the fact that the ridge 22 at one end 23 of the collar 20 has a maximum height, which decreases at both sides of the collar in the direction towards the other end 24 of the collar, as shown in FIG. 5. This means that if the end 24 of the top portion 3 is pushed upwards the ridge 21 can slide over the beginning of the ridge 22 of the collar at both sides of the collar 20 and after that along the ridge 22 until the top portion 3 is separated from the receptacle 1 and vice versa.

Owing to these circumstances, the hinge 25 of the cap 16, FIGS. 6*a-d*, is designed like a shoulder against which one can easily use a thumb to press this end of the top portion 3 upwards for separating the top portion 3 from the receptacle 1. At the other end of the top portion 3 there is a small recess 26 beneath the cap 16. The device according to the invention can, for obvious reasons, be operated easily with only one hand such that the cap 16 is opened by a push with a thumb against the cap 16 at the recess 26, and such that the top portion 3 with closed cap 16, as mentioned before, is separated from the receptacle 1 by a push upwards against the hinge 25. This hinge is of a type that has a resilient spring link 25*a* adapted to either keep the cap 16 in closed or open position.

The invention is of course not restricted to the embodiments here shown and described by way of example but can be modified in different ways within the scope of the invention defined by the patent claims. Thus, the ridges 21 and 22 may for instance change places without influence on the locking function.

The invention claimed is:

1. A portable cigarette ashes container comprising:

a receptacle;

a top portion which is detachable from the receptacle, and which includes a top side in which there are provided: (i) only one circular aperture which is adapted to have cigarette butts inserted therethrough and to open to an interior of the receptacle, and (ii) an additional aperture which opens to an upwards open pocket adapted to be disposed in the receptacle;

a tubular passage made out of heat resistant material and having a same internal diameter as a diameter of the circular aperture in the top portion, wherein the tubular passage is tightly secured at one end thereof to an edge of said circular aperture, wherein the diameter of the circular aperture is substantially the same as a diameter of a cigarette, and wherein the tubular passage is adapted to hold and retain a cigarette butt inserted through the circular aperture; and a cap hingedly connected to the top side of the top portion, wherein said cap includes an interior closure member which is adapted to close the circular aperture in the top side of the top portion when the cap is in a closed position, wherein the pocket has a closed bottom end and is adapted to receive a gas container of a cigarette lighter with a lighter device thereof protruding above the top side of the receptacle, and wherein the pocket has a cross section adapted to a shape of the gas container and is freely located in the receptacle with an edge around the pocket opening being tightly secured to an edge of said additional aperture in the top portion.

2. A portable cigarette ashes container according to claim 1, wherein the receptacle and the top portion comprise a unit with an oval cross-section, and an opening of the receptacle has an edge portion with a ridge extending along an interior of the edge portion, which ridge is adapted to be pushed onto a collar of the top portion, having a shape adapted to the shape of said opening, against and past an exterior ridge on the collar, which exterior ridge extends along a major part of each side of the collar, wherein the ridges of at least one of the receptacle and the collar have declining height in the direction towards one end of the collar, and wherein the top portion has an exterior thumb push surface at one end of the top portion adapted to facilitate a pushing up of said end of the top portion from the receptacle at the opening of the device.

3. A portable cigarette ashes container according to claim 2, wherein the cap covers the circular aperture and the cigarette lighter end protruding up from the pocket, and is hingedly connected by a hinge integrated with the thumb push surface.

4. A portable cigarette ashes container according to claim 2, wherein the edge portion of the receptacle and ridge of said edge portion are outwardly resilient under pressure from the ridge of the collar.

5. A portable cigarette ashes container according to claim 3, wherein the edge portion of the receptacle and the ridge of said edge portion are outwardly resilient under pressure from the ridge of the collar.

6. A portable cigarette ashes container according to claim 5, wherein the receptacle and the top portion comprise a spool-shaped unit.

7. A portable cigarette ashes container according to claim 1, wherein the receptacle and the top portion comprise a spool-shaped unit.

8. A portable cigarette ashes container according to claim 2, wherein the receptacle and the top portion comprise a spool-shaped unit.

9. A portable cigarette ashes container according to claim 3, wherein the receptacle and the top portion comprise of a spool-shaped unit.

10. A portable cigarette ashes container according to claim 4, wherein the receptacle and the top portion comprise a spool-shaped unit.

* * * * *